US011086343B2

(12) United States Patent
Kim

(10) Patent No.: US 11,086,343 B2
(45) Date of Patent: Aug. 10, 2021

(54) ON-CHIP ACTIVE LDO REGULATOR WITH WAKE-UP TIME IMPROVEMENT

(71) Applicant: Winbond Electronics Corp., Taichung (TW)

(72) Inventor: Jungung Kim, San Jose, CA (US)

(73) Assignee: Winbond Electronics Corp., Taichung (TW)

( * ) Notice: Subject to any disclaimer, the term of this patent is extended or adjusted under 35 U.S.C. 154(b) by 0 days.

(21) Appl. No.: 16/690,074

(22) Filed: Nov. 20, 2019

(65) Prior Publication Data

US 2021/0149426 A1 May 20, 2021

(51) Int. Cl.
*G05F 1/56* (2006.01)
*G05F 1/565* (2006.01)

(52) U.S. Cl.
CPC ..... *G05F 1/56* (2013.01); *G05F 1/565* (2013.01)

(58) Field of Classification Search
CPC ... G05F 1/10; G05F 1/267; G05F 1/46; G05F 1/561; G05F 1/567; G05F 1/569; G05F 1/571; G05F 1/573; G05F 1/5735; G05F 1/461; G05F 1/462; G05F 1/463; G05F 1/465; G05F 1/466; G05F 1/467; G05F 1/56; G05F 1/562; G05F 1/563; G05F 1/565; G05F 1/575; G05F 1/577; G05F 1/585; G05F 1/59; G05F 1/595; G05F 1/607; G05F 1/61; G05F 1/613; G05F 1/614; G05F 1/618; G05F 1/62; G05F 1/66; G05F 1/08; G05F 1/153; G05F 1/16; G05F 1/26; G05F 1/34; G05F 3/02; G05F 3/30; G05F 3/22; G05F 3/222; G05F 3/242;
(Continued)

(56) References Cited

U.S. PATENT DOCUMENTS 8,026,703 B1 9/2011 Damaraju et al.
8,258,766 B1 9/2012 Sutardja
(Continued)

FOREIGN PATENT DOCUMENTS

CN 101815974 8/2010
CN 105549673 1/2017
(Continued)

OTHER PUBLICATIONS

"Office Action of Taiwan Counterpart Application", dated Jun. 3, 2021, pp. 1-7.

*Primary Examiner* — Bryan R Perez
(74) *Attorney, Agent, or Firm* — JCIPRNET

(57) ABSTRACT

A method of regulating a low-dropout (LDO) regulator is provided. The method includes: generating a feedback voltage by receiving a feedback from an output node of the LDO regulator, generating a control signal to drive a pass element by receiving the feedback voltage and a reference voltage, detecting a voltage at a first node and controlling a switching operation of a first switch according to a detection result by a detection circuit. When the LDO regulator is operating in an active mode, the first switch is turned on to connect the first node and a control terminal of the pass element and when the LDO regulator is operating in a standby mode, the first switch is turned off to disconnect the first node from the control terminal of the pass element. A low-dropout (LDO) regulator is also provided.

18 Claims, 4 Drawing Sheets

(58) Field of Classification Search
CPC . G05F 3/225; G05F 3/245; G05F 3/20; G05F 3/00; G05F 3/08; G05F 3/10; G05F 3/16; G05F 3/18; G05F 3/185; G05F 3/227; G05F 3/247; G05F 3/26; G05F 3/265; G05F 3/24; G05F 3/262
See application file for complete search history.

(56) References Cited

U.S. PATENT DOCUMENTS

| | | | | |
|---|---|---|---|---|
| 8,542,059 | B2 | 9/2013 | Tejada et al. | |
| 9,146,569 | B2 | 9/2015 | Li et al. | |
| 9,310,816 | B2 | 4/2016 | Chang et al. | |
| 9,710,002 | B2 | 7/2017 | Easwaran et al. | |
| 2010/0289472 | A1 | 11/2010 | Renous | |
| 2012/0313696 | A1 | 12/2012 | Tejada et al. | |
| 2013/0234684 | A1 | 9/2013 | Chang et al. | |
| 2015/0015223 | A1* | 1/2015 | Chen | G05F 1/575 323/280 |

FOREIGN PATENT DOCUMENTS

| | | |
|---|---|---|
| TW | 201250424 | 12/2012 |
| TW | 201327085 | 7/2013 |
| TW | I506394 | 11/2015 |
| WO | 2009133512 | 11/2009 |
| WO | 2011026047 | 3/2011 |
| WO | 2015127018 | 8/2015 |
| WO | 2019213031 | 11/2019 |

* cited by examiner

ON-CHIP ACTIVE LDO REGULATOR WITH WAKE-UP TIME IMPROVEMENT

BACKGROUND OF THE INVENTION

Technical Field

The present disclosure relates to a voltage regulator, and more relates to an on-chip active Low drop out (LDO) regulator.

Description of Related Art

Nowadays, in typical DRAM and NAND memory device an on-chip LDO regulator is usually employed. The LDO regulator has an active mode and a standby mode based on a loading conditions in the memory device. During the mode transitions from the standby mode to the active mode, the LDO regulator tend to suffer from long wake-up time. Due to high RC time constant associated with a large compensation capacitance in a feedback loop in the LDO regulator, degrades a loop response during a wake-up. On the other hand, if a load current draws before the LDO regulators settled to the constant value, the voltage at an output node of the LDO regulator droops further, which leads to an error during a data transfer in the memory device.

Along with requirement of overcoming the long wake up time during the mode transitions from the standby mode to the active mode, it could be desirable to develop a LDO regulator with improved wake-up response for certain applications in this field.

SUMMARY OF THE INVENTION

A low-dropout (LDO) regulator of the disclosure includes a pass element, a feedback circuit, an error amplifier, a compensation capacitor, and a detection circuit. The pass element is connected between a power supply voltage and an output node of the LDO regulator. The feedback circuit is configured to receive a feedback from the output node and generates a feedback voltage. The error amplifier is configured to receive the feedback voltage and a reference voltage to generate a control signal to drive the pass element. The compensation capacitor includes a first terminal and a second terminal, where the first terminal is coupled to a first node and the second terminal is coupled to the output node of the LDO regulator. The detection circuit is configured to detect a voltage at the first node and controls a first switch according to a detection result. When the LDO regulator is operating in an active mode, the first switch is turned on to connect the first node and a control terminal of the pass element and when the LDO regulator is operating in a standby mode, the first switch is turned off to disconnect the first node from the control terminal of the pass element.

A method of regulating a low-dropout (LDO) regulator is provided. The method includes: generating a feedback voltage by receiving a feedback from an output node of the LDO regulator, generating a control signal to drive a pass element by receiving the feedback voltage and a reference voltage, detecting a voltage at a first node and controlling a switching operation of a first switch according to a detection result by a detection circuit. When the LDO regulator is operating in an active mode, the first switch is turned on to connect the first node and a control terminal of the pass element and when the LDO regulator is operating in a standby mode, the first switch is turned off to disconnect the first node from the control terminal of the pass element.

Based on the above, in the embodiments of the disclosure, when the LDO regulator is operating in active mode, the first switch is turned on to connect the first node and the pass element, and when the LDO regulator is operating a standby mode, the first switch is turned off to disconnect the first node from the pass element. As such, discharging time of the output of error amplifier is improved due to charge sharing, thereby improving the wake-up response of the LDO regulator and reducing the voltage drop/undershoot voltage of the LDO regulator.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
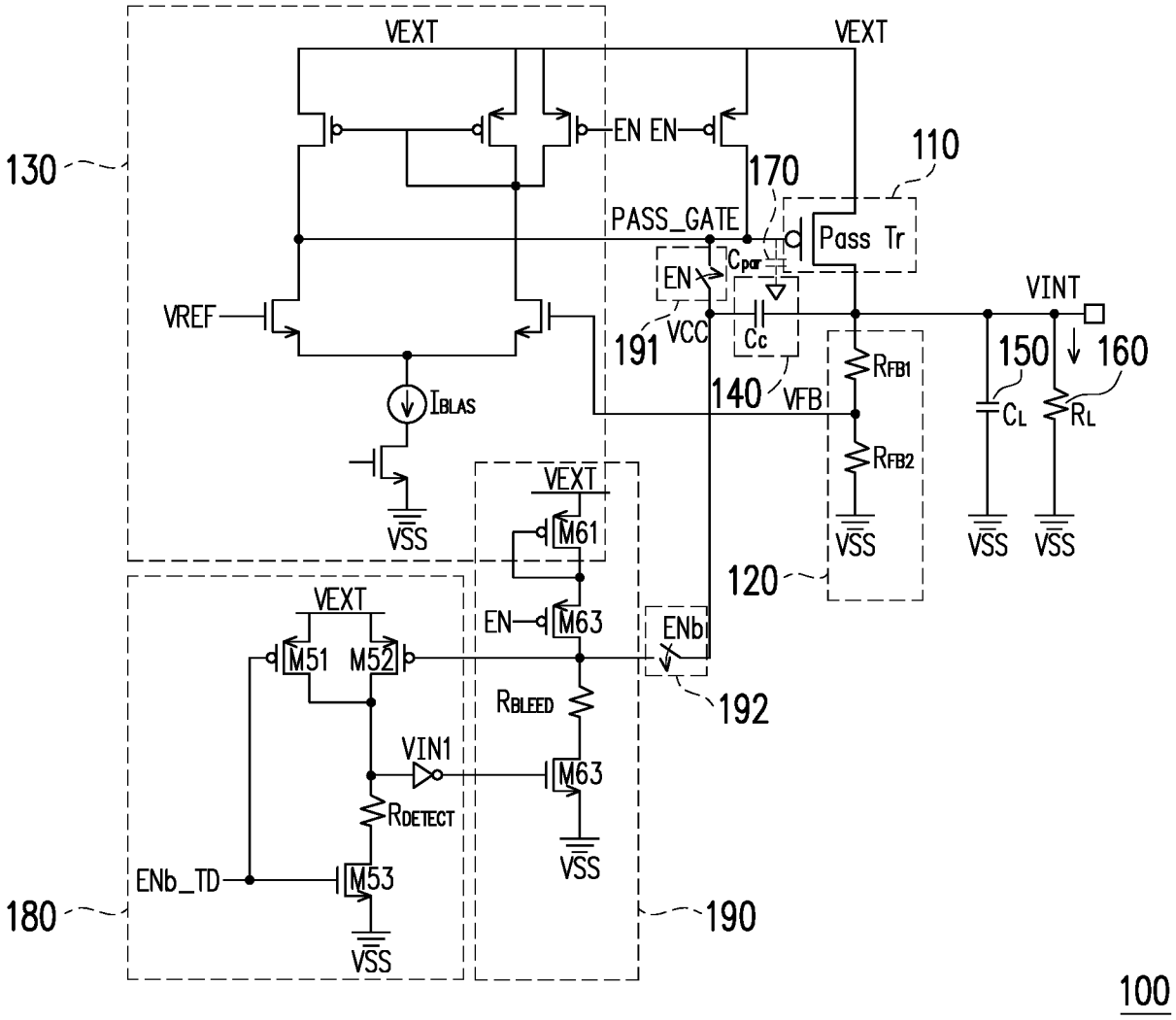
FIG. 1 illustrates a circuit diagram of a LDO regulator according to an exemplary embodiment of the disclosure.

FIG. 1 illustrates a circuit diagram of a LDO regulator according to an exemplary embodiment of the disclosure. Referring to FIG. 1, the LDO regulator 100 includes a pass element 110, a feedback circuit 120, an error amplifier 130, a compensation capacitor Cc 140, an output capacitor $C_L$ 150, a load resistor $R_L$ 160, a parasitic capacitor Cpar 170, a detection circuit 180, a driver circuit 190, a first switch 191, and a second switch 192.

The pass element 110 is a PMOS transistor that includes a source terminal, a drain terminal, and a control terminal. The source terminal is coupled to a power supply voltage VEXT. The drain terminal is coupled to an output node VINT of the LDO regulator 100. The control terminal of the pass element 110 is coupled to an output node of the error amplifier 130. The pass element 110 is also defined as a pass transistor Pass Tr.

The feedback circuit 120 is configured to receive a feedback from the output node VINT of the LDO regulator 100. The feedback circuit 120 includes a first feedback resistor $R_{FB1}$ and a second feedback resistor $R_{FB2}$. The first feedback resistor $R_{FB1}$ is coupled between the output node of the LDO regulator 100 and the second feedback resistor $R_{FB2}$. Similarly, the second feedback resistor $R_{FB2}$ is coupled between the first feedback resistor $R_{FB1}$ and the ground potential VSS. The feedback circuit 120 generates a feedback voltage VFB to the error amplifier 130 based on a voltage at the output node VINT of the LDO regulator 100.

The error amplifier 130 is configured to receive the feedback voltage VFB and a reference voltage VREF to generate a control signal to drive the pass element 110. The error amplifier 130 is an operational amplifier with two input terminals and one output terminal. In other words, an inverting terminal and a non-inverting terminal and an output terminal. The error amplifier 130 receives the feedback voltage VFB at the non-inverting terminal and the reference voltage VREF at the inverting terminal. The reference voltage VREF is a predetermined voltage and are defined by the user.

The compensation capacitor Cc 140 includes a first terminal and a second terminal. The first terminal is coupled to a first node VCC and the second terminal is coupled to an output node VINT of the LDO regulator 100. The compensation capacitor Cc 140 is also defined as Miller capacitance, used for frequency compensation in the voltage regulator. The compensation capacitor/Miller capacitance Cc 140 is a well-known in the art, thus the description is omitted.

The output capacitor $C_L$ 150 is coupled between the output node VINT of the LDO regulator and the ground potential VSS. The output capacitor 150 is also defined as a load capacitor $C_L$.

Similarly, the load resistor $R_L$ 160 is coupled between the output node VINT of the LDO regulator and the ground potential VSS.

The parasitic capacitor Cpar 170 is coupled between the control terminal of the pass element and the ground potential VSS.

The detection circuit 180 is configured to detect a voltage at the first node VCC and a voltage at the driver circuit 190 and controls the first switch 191 according to a detection result.

The detection circuit 180 includes a transistor M51, a transistor M52, a transistor M53, a detection resistor Rdetect and an inverter INV1. The transistor M51 and the transistor M52 are PMOS transistors. The transistor M53 is a NMOS transistor.

The transistor M51, the transistor M52 and the transistor M53 includes a source terminal, a drain terminal and a control terminal. The source terminal of the transistor M51 and the source terminal of the transistor M52 is coupled to a power supply voltage VEXT and the drain terminal of the transistor M51 and the drain terminal of the transistor M52 are connected each other. The control terminal of the transistor M51 and the control terminal of the transistor M53 are coupled to a enable signal Enb_TD.

The detection resistor Rdetect is coupled between an input terminal of the inverter INV1 and the drain terminal of the transistor M53. The source terminal of the transistor M53 is coupled to a ground potential VSS. The output terminal of the inverter INV1 is coupled to a driver circuit 380.

In some embodiments, the N-type transistors are used to replace the detection resistor Rdetect.

The driver circuit 390 is configured charge and discharge the first node VCC. The driver circuit 390 includes a transistor M61, a transistor M62, a transistor M63, and a resistor Rbleed. The transistor M61, the transistor M62, and the transistor M63 includes a source terminal, a drain terminal, and a control terminal. The transistor M61 and the transistor M62 are PMOS transistors. The transistor M63 is a NMOS transistor.

The transistor M61 is a diode connected PMOS. In detail, the control terminal of the transistor M61 is coupled to the drain terminal of the transistor M61. The source terminal of the transistor M61 is coupled to the power supply voltage VEXT.

The source terminal of the transistor M62 is coupled to the drain terminal of the transistor M61 and the drain terminal of the transistor M62 is coupled to one end of the resistor Rbleed. The control terminal of the transistor M62 is controlled by an enable signal EN. The other end of the resistor Rbleed is coupled to the drain terminal of the transistor M63 and the source terminal of the transistor M63 is coupled to the ground potential VSS. The control terminal of the transistor M63 is coupled to the output terminal of the inverter INV1 of the detection circuit 180.

In some embodiments, the N-type transistors are used to replace the resistor Rbleed.

The second switch 192 is coupled to the first node and the drain terminal of the transistor M62. The second switch 192 is configured to connect the first node VCC and the driver circuit 190 during charging and discharging the first node.

The first switch 191 is coupled to between the first node VCC and the output terminal of the error amplifier 130. In other words, the first switch 191 is coupled between the control terminal of the pass element 110 and the first node VCC.

The detection circuit 180 is configured to detect a voltage of the first terminal of the compensation capacitor Cc 140 and driver circuit 190 and controls the first switch 191 and the second switch 192 to connect the compensation capacitor Cc 140 to the control terminal of the pass element 110 in an active mode and disconnect the compensation capacitor Cc 140 to the control terminal of the pass element 110 in a standby mode to improve a discharge time of the pass element 110 without increasing a tail current $I_{BIAS}$ of the error amplifier 130.

In detail, when EN=0, the first node VCC is connected to the driver circuit 190 and pre-charge the first node VCC at a predetermined voltage VEXT−|Vthp| through the diode connected PMOS transistor M61. It is noted that the predetermined voltage VEXT−|Vthp| is same as a voltage at the pass element 110. When EN=1, the LDO regulator 100 turns on, then the first node VCC is connected to the control terminal of the pass element 110. During this condition, a charging sharing process occurs and the voltage at the control terminal of the pass element 110 goes down to the predetermined voltage VEXT−|Vthp| in a short period of time due the compensation capacitor Cc 140 is larger than the parasitic capacitor Cpar 170. Typically, the compensation capacitor Cc 140 is larger than the parasitic capacitor Cpar 170 in the LDO regulator 100. This results in reducing the discharge time of the pass element 110 by $|Cc*|Vthp|/I_{BIAs}$. The first node VCC is initialized to the first predetermined voltage VEXT−|Vthp| during EN=0 is to prevent the overshoot at output of the LDO regulator 100 during the wake-up process.

Figure 2A:
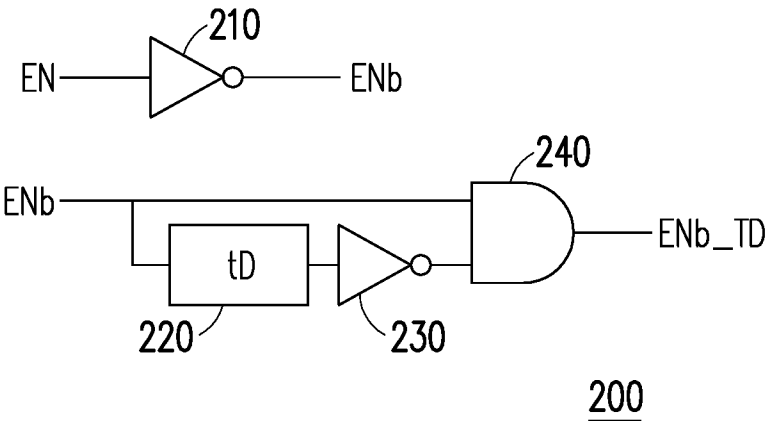
FIG. 2A illustrates a circuit diagram of an enable pulse generator according to an exemplary embodiment of the disclosure.

FIG. 2A illustrates a circuit diagram of an enable pulse generator according to an exemplary embodiment of the disclosure. The enable pulse generator 200 includes an inverter 210, a pulse generator tD 220, an inverter 230, a logic gate 240.

The inverter 210 is configured to receive an enable signal EN and generates an enable signal ENb. The delay of the enable signal ENb is determined by the number of inverters. In this embodiment, the inverter 210 is used to generate a enable signal ENb.

The pulse generator tD 220 receives the enable signal ENb and the generates an output to the inverter 230. The inverter 230 receives the output of the pulse generator tD 220 and generates a delay signal to the logic gate 240.

The logic gate 240 is a 2 input AND gate. One input of the AND gate is the second enable signal ENb and another input is the delay signal from the inverter 230 and generates an enable signal ENb_TD.

In some embodiments, the logic gate 240 may be AND, OR, NOT, EXOR, EXNOR, Flip flops, and so on. Hence the logic gate 240 in this disclosure is not limited thereto.

Figure 2B:
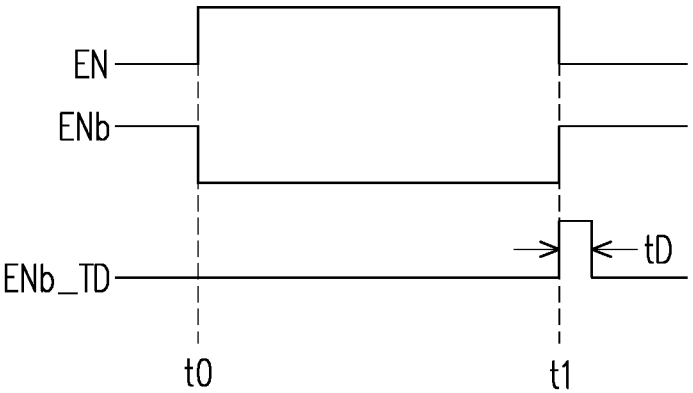
FIG. 2B illustrates an operation waveform of an enable pulse generator according to an exemplary embodiment of the disclosure.

FIG. 2B illustrates an operation waveform of an enable pulse generator according to an exemplary embodiment of the disclosure. With reference to FIG. 2A, when an enable signal EN goes to logic high "1", an enable signal EN_b goes to logic low "0" at time t0. It is noted that the enable signal EN and the enable signal EN_b are inverted signal.

When the enable signal EN_b reaches the logic low "0" to logic high "1" at time t1, an enable signal EN_TD goes from logic low "0" to high "1" for short period of time tD. The time tD is also defined as transition detection pulse. It is noted that the enable signal EN, the enable signal EN_b, and the enable signal EN_TD are used for a detection circuit 180 with reference to FIG. 1.

Figure 3:
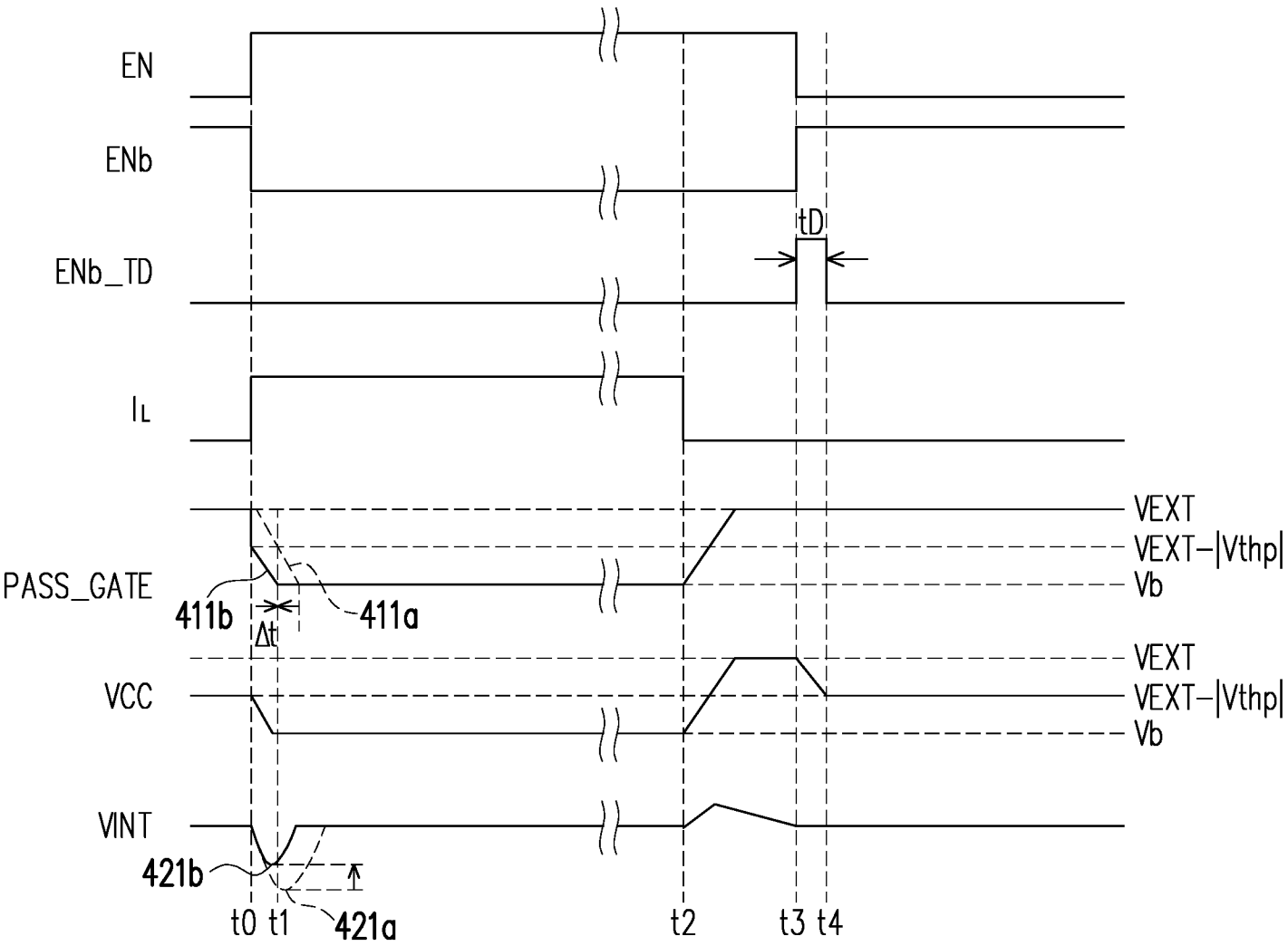
FIG. 3 illustrates an operation waveform of a LDO regulator according to an exemplary embodiment of the disclosure.

FIG. 3 illustrates an operation waveform of a LDO regulator according to an exemplary embodiment of the disclosure. Same elements in FIG. 3 have a same reference numbers as the LDO regulator 100 in FIG. 1.

With reference to FIG. 1 and FIG. 2B, during a mode transition from a standby mode to an active mode, an enable signal EN goes from high to low. After that, a transistor detection pulse which has a pulse width of tD is generated. The transition detection pulse tD is a short pulse, which is used to initialize a first node VCC with a predetermined voltage VEXT−|Vthp|. In other words, an enable signal EN_TD is high during the transition detection pulse tD, a detection circuit 180 detects a voltage at the first node VCC. The detection circuit 180 compares the voltage of the VCC with the predetermined voltage VEXT−|Vthp|. If the voltage at the first node VCC is higher than the predetermined voltage VEXT−|Vthp|, the driver circuit 190 drives the first node VCC to discharge the voltage at the first node VCC. On contrary, if the voltage at the first node VCC is lower than the predetermined voltage VEXT−|Vthp|, the diode connected PMOS M61 in the driver circuit 190 charges the first node VCC.

In detail, during the mode transition from the standby mode to the active mode, the voltage at the pass element 110 starts to discharge from an power supply voltage VEXT to the predetermined voltage VEXT−|Vthp| at time t0. After that in time t1, the pass element 110 starts to discharge from the first predetermined voltage VEXT−|Vthp| to Vb at the time Δt, where Δt is a discharge time of the pass element 110. It is noted that, the time taken to discharge the pass element 110 from VEXT to Vb 411*a* in conventional LDO is much higher than the time taken to discharge the pass element 110 from VEXT to Vb 411*b*. As such a undershoot voltage 421*b* at an output node VINT of the LDO regulator 100 is much smaller than the undershoot voltage 421*a* of the conventional LDO regulator.

Typically, the compensation capacitor Cc 140 is larger than the parasitic capacitor 170. The slew rate (SR) and the discharge time (Δt) of the pass element 110 is calculated as, $$\text{Slew rate } (SR) = \frac{I_{bias}}{(C_C + C_{par})} \approx \frac{I_{bias}}{C_C} \text{ if } C_C \gg C_{par} \tag{1}$$

$$\text{Discharge time}(\Delta t) = \frac{C_C}{I_{bias}}(VEXT - |Vthp| - V_b) \tag{2}$$

$$\text{Discharge time}(\Delta t, \text{conventional}) = \frac{C_C}{I_{bias}}(VEXT - V_b) \tag{3}$$

After the enable signal EN goes from logic high to logic low, the transition detection pulse tD is generated. At this time, the first node VCC is charge to VEXT at time t2, then the detector compares the voltage at the first node VCC and the predetermined voltage VEXT−|Vthp|. If the first node VCC is higher than the predetermined voltage VEXT−|Vthp| is detected at time t3, the driver circuit 190 discharges the first node VCC to VEXT−|Vthp| at time t4. On contrary, if the first node VCC is lower than the predetermined voltage VEXT−|Vthp|, then a diode connected PMOS M61 charges the first node VCC.

Based on the above, during the standby mode, the compensation capacitor Cc 140 is pre charged to the predetermined voltage VEXT−|Vthp|, thus the compensation capacitor Cc 140 starts to discharge to the voltage Vb from the predetermined voltage VEXT−|Vthp|, which is lower than the VEXT, thus improving the wake-up time in the LDO regulator 100.

Figure 4:
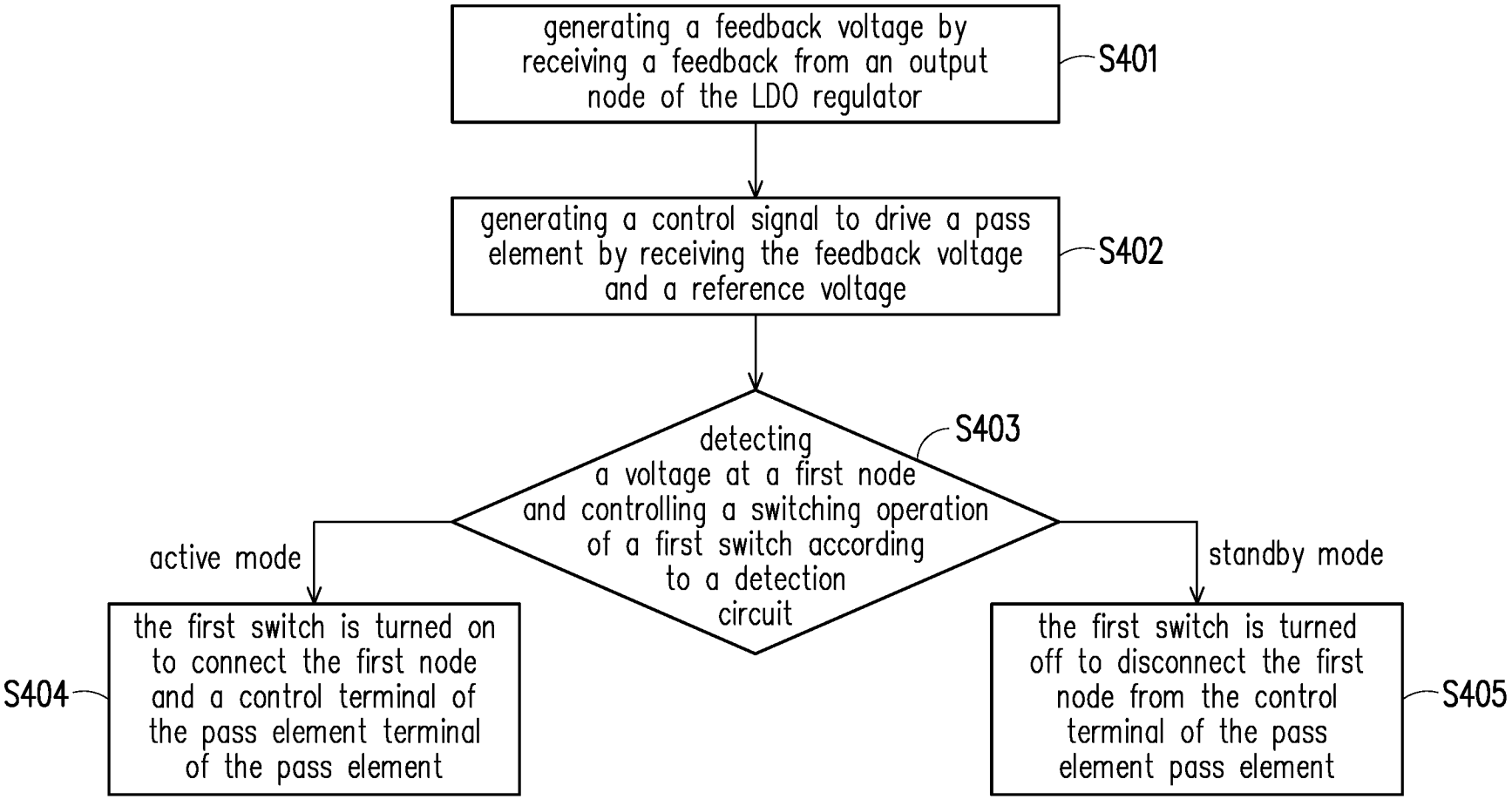
FIG. 4 illustrates a method of regulating a LDO regulator according to an exemplary embodiment of the disclosure.

FIG. 4 illustrates a method of regulating a LDO regulator according to an exemplary embodiment of the disclosure. The method of regulating the LDO regulator includes: generating a feedback voltage by receiving a feedback from an output node of the LDO regulator in step S401.

In step S402, generating a control signal to drive a pass element by receiving the feedback voltage and a reference voltage. In step S403, detecting a voltage at a first node and controlling a switching operation of a first switch according to a detection result by a detection circuit. When the LDO regulator is operating in an active mode, the first switch is turned on to connect the first node and a control terminal of the pass element in step S404. When the LDO regulator is operating in a standby mode, the first switch is turned off to disconnect the first node from the control terminal of the pass element in step S405.

In summary of the embodiments in the disclosure, during the standby mode, the compensation capacitor Cc is pre-charged to the predetermined voltage VEXT−|Vthp|, thus the compensation capacitor Cc starts to discharge to the voltage Vb from the predetermined voltage VEXT−|Vthp|, which is lower than the power supply voltage VEXT, thus improving the wake-up time in the LDO regulator.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A low-dropout (LDO) regulator comprising:

a pass element, connected between a power supply voltage and an output node of the LDO regulator;

a feedback circuit, configured to receive a feedback from the output node and generates a feedback voltage;

an error amplifier, configured to receive the feedback voltage and a reference voltage to generate a control signal to drive the pass element;

a compensation capacitor, comprising a first terminal and a second terminal, wherein the first terminal is coupled to a first node and the second terminal is coupled to the output node of the LDO regulator; and a detection circuit, configured to detect a voltage at the first node and controls a first switch according to a detection result, wherein when the LDO regulator is operating in an active mode, the first switch is turned on to connect the first node and a control terminal of the pass element and when the LDO regulator is operating in a standby mode, the first switch is turned off to disconnect the first node from the control terminal of the pass element.

2. The LDO regulator of claim 1, wherein the first switch is coupled between the first node and the control terminal of the pass element.

3. The LDO regulator of claim 1, further comprising:

a driver circuit, configured to charge and discharge the first node; and a second switch, configured to connect the driver circuit and the first node.

4. The LDO regulator of claim 3, wherein when the first switch changes from turn on to turn off, a transition detection pulse is generated to initialize the first node with a first predetermined voltage by the driver circuit.

5. The LDO regulator of claim 4, wherein when the transition detection pulse is generated, the detection circuit compares a voltage at the first node and the first predetermined voltage.

6. The LDO regulator of claim 5, wherein when the voltage at the first node is higher than the first predetermined voltage, the driver circuit discharges the first node.

7. The LDO regulator of claim 5, wherein when the voltage at the first node is lower than the first predetermined voltage, the driver circuit charges the first node.

8. The LDO regulator of claim 7, wherein the driver circuit comprises a diode connected PMOS configured to charge the first node to the first predetermined voltage during charging.

9. The LDO regulator of claim 8, wherein the detection circuit is coupled to the driver circuit to detect a voltage of the diode connected PMOS.

10. A method of regulating a low-dropout (LDO) regulator comprising:

generating a feedback voltage by receiving a feedback from an output node of the LDO regulator;

generating a control signal to drive a pass element by receiving the feedback voltage and a reference voltage; and detecting a voltage at a first node and controlling a switching operation of a first switch according to a detection result by a detection circuit, wherein a first terminal of a compensation capacitor of the LDO regulator is coupled to the first node and a second terminal of the compensation capacitor of the LDO regulator is coupled to the output node, wherein when the LDO regulator is operating in an active mode, the first switch is turned on to connect the first node and a control terminal of the pass element and when the LDO regulator is operating in a standby mode, the first switch is turned off to disconnect the first node from the control terminal of the pass element.

11. The method of claim 10, wherein the first switch is coupled between the first node and the control terminal of the pass element.

12. The method of claim 10, further comprising:

perform a charging operation and a discharging operation on the first node.

13. The method of claim 12, wherein when the first switch changes from turn on to turn off, a transition detection pulse is generated to initialize the first node with a first predetermined voltage by the driver circuit.

14. The method of claim 13, wherein when the transition detection pulse is generated, the detection circuit compares a voltage at the first node and the first predetermined voltage.

15. The method of claim 14, wherein when the voltage at the first node is higher than the first predetermined voltage, the driver circuit discharges the first node.

16. The method of claim 14, wherein when the voltage at the first node is lower than the first predetermined voltage, the driver circuit charges the first node.

17. The method of claim 16, wherein the driver circuit comprises a diode connected PMOS configured to charge the first node to the first predetermined voltage during charging.

18. The method of claim 17, wherein the detection circuit is coupled to the driver circuit to detect a voltage of the diode connected PMOS.

* * * * *